US010686278B2

(12) United States Patent
Herbrechtsmeier et al.

(10) Patent No.: US 10,686,278 B2
(45) Date of Patent: Jun. 16, 2020

(54) MULTI-PART RETAINING FRAME, METHOD FOR ASSEMBLING AND EQUIPPING

(71) Applicant: HARTING Electric GmbH & Co. KG, Espelkamp (DE)

(72) Inventors: Heiko Herbrechtsmeier, Bünde (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/318,350

(22) PCT Filed: May 18, 2017

(86) PCT No.: PCT/EP2017/061999
§ 371 (c)(1),
(2) Date: Jan. 16, 2019

(87) PCT Pub. No.: WO2018/015045
PCT Pub. Date: Jan. 25, 2018

(65) Prior Publication Data

US 2019/0229457 A1 Jul. 25, 2019

(30) Foreign Application Priority Data

Jul. 20, 2016 (DE) ..... 10 2016 213 286

(51) Int. Cl.
*H01R 13/514* (2006.01)
*H01R 13/518* (2006.01)

(52) U.S. Cl.
CPC ..... *H01R 13/514* (2013.01); *H01R 13/518* (2013.01)

(58) Field of Classification Search
CPC .. H01R 13/506; H01R 13/508; H01R 13/514; H01R 13/516; H01R 13/518
See application file for complete search history.

(56) References Cited

U.S. PATENT DOCUMENTS 4,729,064 A * 3/1988 Singer, Jr. ..... H04Q 1/149 361/119
5,108,303 A * 4/1992 Maeda ..... H01R 13/5219 439/271

(Continued)

FOREIGN PATENT DOCUMENTS

CN 86 107 946 A 7/1987
CN 201656115 U 11/2010

(Continued)

OTHER PUBLICATIONS

International Search Report and Written Opinion, dated Sep. 13, 2017, for International Application No. PCT/EP2017/061999, 13 pages (with English Translation of Search Report).

*Primary Examiner* — Edwin A. Leon
*Assistant Examiner* — Milagros Jeancharles
(74) *Attorney, Agent, or Firm* — Seed IP Law Group LLP

(57) ABSTRACT

The present disclosure relates to the field of holding frames for a plug connector for receiving similar and/or different modules. To provide a solution which retains the flexibility in the number of insertable modules which previously resulted from being able to select a matching holding frame, while allowing a more efficient layout, manufacturing, storage and/or use, an appropriate holding frame arrangement is proposed in which the modules in a holding frame arrangement to be populated with modules are arranged one beside the other in a longitudinal direction thereof, between a first and a second end face of the holding frame arrangement, wherein the first and the second end faces are configured to be joined to each other form-fittingly such that, in a populating state, at least one transversely extending projection of one of the modules is received in a receptacle in at least one of opposing side surfaces of the holding frame arrangement, which extend between the first and the second end faces.

7 Claims, 2 Drawing Sheets

(56) References Cited

U.S. PATENT DOCUMENTS

| | | | | |
|---|---|---|---|---|
| 5,129,842 | A | 7/1992 | Morgan et al. | |
| 5,725,397 | A * | 3/1998 | Fukamachi | H01R 13/514 439/596 |
| 6,004,162 | A * | 12/1999 | Harting | H01R 13/518 439/532 |
| 6,113,414 | A | 9/2000 | Fukuda | |
| 6,699,073 | B1 * | 3/2004 | Wu | H01R 13/514 439/579 |
| 7,316,591 | B2 * | 1/2008 | Ferderer | H01R 13/506 439/532 |
| 7,322,842 | B2 * | 1/2008 | Duck | G02B 6/381 200/51.03 |
| 7,422,490 | B2 * | 9/2008 | Droesbeke | H01R 13/514 439/701 |
| 7,909,619 | B2 * | 3/2011 | Pepe | H01R 13/514 439/541.5 |
| 7,967,638 | B1 * | 6/2011 | Kline | H01R 12/7082 439/607.07 |
| 8,287,306 | B2 | 10/2012 | Daugherty et al. | |
| 9,192,537 | B2 | 11/2015 | Schlegel | |
| 9,257,788 | B1 * | 2/2016 | Jia | H01R 13/518 |
| 9,502,813 | B2 * | 11/2016 | Dugo | H01R 9/2408 |
| 9,923,307 | B2 * | 3/2018 | Beischer | H01R 13/514 |
| 10,050,391 | B2 * | 8/2018 | Herbrechtsmeier | H01R 13/506 |
| 10,128,604 | B2 | 11/2018 | Li et al. | |
| 10,148,046 | B2 * | 12/2018 | Schlepp | H01R 13/73 |
| 10,177,484 | B2 * | 1/2019 | Schonfeld | H01R 13/518 |
| 10,276,968 | B2 | 4/2019 | Herbrechtsmeier et al. | |
| 10,283,900 | B2 | 5/2019 | Herbrechtsmeier et al. | |
| 10,333,244 | B2 | 6/2019 | Herbrechtsmeier et al. | |
| 2006/0207782 | A1 | 9/2006 | Pearse et al. | |
| 2007/0155252 | A1 | 7/2007 | Ferderer | |
| 2016/0276778 | A1 | 9/2016 | Beischer et al. | |
| 2016/0285194 | A1 | 9/2016 | Herbrechtsmeier | |
| 2018/0026405 | A1 | 1/2018 | Schlepp et al. | |
| 2018/0248298 | A1 | 8/2018 | Schonfeld et al. | |
| 2018/0277978 | A1 | 9/2018 | Schonfeld et al. | |
| 2019/0140388 | A1 * | 5/2019 | Mossig | H01R 13/502 |

FOREIGN PATENT DOCUMENTS

| | | | |
|---|---|---|---|
| CN | 203135090 | U | 8/2013 |
| CN | 203277786 | U | 11/2013 |
| CN | 203326246 | U | 12/2013 |
| CN | 103996925 | A | 8/2014 |
| CN | 205212055 | U | 5/2016 |
| DE | 298 12 500 | U1 | 10/1998 |
| DE | 10 2013 113 976 | A1 | 6/2015 |
| DE | 10 2015 101 433 | B3 | 6/2016 |
| EP | 0 508 870 | A1 | 10/1992 |
| EP | 0 736 931 | B1 | 8/1999 |
| EP | 0 860 906 | B1 | 5/2004 |
| EP | 1 801 927 | B1 | 5/2010 |
| EP | 2 581 991 | A2 | 4/2013 |
| FR | 2 781 092 | A1 | 1/2000 |
| JP | 2002-305829 | A | 10/2002 |
| TW | 201328044 | A1 | 7/2013 |
| WO | 2014075662 | A1 | 5/2014 |

* cited by examiner

MULTI-PART RETAINING FRAME, METHOD FOR ASSEMBLING AND EQUIPPING

BACKGROUND

Technical Field

The present disclosure relates to the field of holding frames for modules and in particular of holding frames for a plug connector for receiving similar and/or different modules.

Holding frames are used to accommodate a plurality of similar and/or different modules. These modules may be insulating bodies, for example, which are provided as contact holders for electronic and electrical and possibly also for optical and/or pneumatic contacts.

Description of the Related Art

A holding frame for holding plug connector modules and for installation in plug connection casings or for screwing onto wall surfaces is known from document EP 0 860 906 B1, in which the plug connector modules are inserted into the holding frame and holding means on the plug connector modules cooperate with recesses provided on opposite wall parts (side parts) of the holding frame, wherein the recesses in the form of openings which are bounded on all sides are provided in the side parts of the holding frame, wherein the holding frame separates along a line which is parallel to the side parts of the holding frame, and wherein hinges are arranged in fastening ends of the holding frame in such a way that when the holding frame is screwed onto a fastening surface, the frame parts are oriented in such a way that the side parts of the holding frame are oriented at right angles to the fastening surface and the plug connector modules are connected interlockingly to the holding frame by the holding means. In practice, such holding frames are normally made in a die casting process, and more particularly in a zinc die casting process.

Document EP 2 581 991 A1 discloses a holding frame for plug connector modules, comprising two frame halves which can be latched to each other by linear displacement of the one frame half relative to the other frame half in a sliding direction, wherein mutually corresponding latching means are provided on the frame halves and cause the two frame halves to latch into each other in two different latching positions during linear displacement, in which the frame halves are spaced from each other at different distances.

Document EP 1 801 927 B1 discloses a holding frame consisting of an integral injection-molded plastic part. The holding frame is formed as a circumferential collar and on its mating side has a plurality of wall segments which are separated by slits. A respective pair of opposite wall segments form an insertion region for a plug-in module, the wall segments having window-like apertures for receiving projections integrally molded with the narrow sides of the modules. A guide groove is also provided in each of the wall segments. The guide groove is formed above the apertures by means of an outwardly offset window web which has an insertion bevel on the inner surface. The plug-in modules also have latching arms integrally molded on the narrow sides, which act in the direction of the cable connectors, and which latch into place under the lateral collar wall, so that two independent latching means fix the plug connector module in the holding frame.

In order to specify a structural design for a holding frame which has good heat resistance and high mechanical robustness and which allows protective earthing, also and in particular when installed in a metal plug connector casing, and which also ensures ease of operation, especially when replacing individual modules, document DE 10 2013 113 976 A1 proposes providing a base section (preferably die cast and made of zinc or aluminum or an appropriate alloy, for example) for fixing a received module in a plane and a deformation section (preferably a die formed resilient metal sheet) which can adopt an insertion state and a holding state, the insertion state allowing at least one module to be inserted into the holding frame in a direction transverse to the plane, and a received module being fixed in place in the holding state. The base section and the deformation section are formed at least partly from different materials, in any case.

What the known holding frames described in EP 0 860 906 B1, EP 2 581 991 A1, EP 1 801 927 B1 and DE 10 2013 113 976 A1 have in common is that their layouts are each configured, due to their design and construction, for only a certain number of modules or module slots, although it is possible that two or more of the module slots each provided for one (narrower) module are occupied by a module of corresponding width.

One consequence of configuring the layout for a specific number of module slots is that different holding frames are designed and produced for different applications (each involving a different number of modules or module slots). In addition to the work and expense that configuration and production involves for the manufacturer of the holding frames, it is also necessary that the user keeps an appropriate stock of parts and implements appropriate measures to ensure that the user has appropriate holding frames available for the respective application that are neither too short (i.e., have too few module slots) nor too long (i.e., may not fit spatially into the respective environment provided).

BRIEF SUMMARY

A basic aim of embodiments of the present invention is to provide a holding frame which facilitates configuration, manufacture, logistics and use for manufacturers and users, in comparison with known solutions, without significantly limiting its potential uses, particularly with regard to the number of modules that can be inserted.

It is therefore desirable to provide a solution which retains the flexibility in the number of insertable modules, which previously resulted from being able to select a matching holding frame, while allowing more efficient configuration, manufacturing, storage and/or use.

According to one aspect of the invention, a holding frame arrangement for a plug connector for receiving similar and/or different modules is proposed, namely a holding frame arrangement for a plug connector for receiving similar and/or different modules, wherein the modules in the holding frame arrangement to be populated with modules are arranged one beside the other in the longitudinal direction thereof, between a first and a second end face of the holding frame arrangement, wherein the first and the second end faces can be joined to each other form-fittingly such that, in a populating state, at least one transversely extending projection of one of the modules is received in a receptacle in at least one of opposing side surfaces of the holding frame arrangement, which extend between the first and the second end faces.

According to another aspect of the invention, an assembly method for a holding frame arrangement for a plug connector for receiving similar and/or different modules is proposed, namely: providing a holding frame arrangement for a plug connector for receiving similar and/or different modules, wherein the modules in the holding frame arrangement to be populated with modules are arranged one beside the other in the longitudinal direction thereof, between a first and a second end face of the holding frame arrangement, wherein the first and the second end faces can be joined to each other form-fittingly such that, in a populating state, at least one transversely extending projection of one of the modules is received in a receptacle in at least one of opposing side surfaces of the holding frame arrangement, which extend between the first and the second end faces, and wherein the side surfaces each have predetermined breaking points for shortening them by integer multiples of a module width; and shortening the side surfaces by breaking them at two predetermined breaking points.

According to yet another aspect of the invention, a populating method for a holding frame arrangement for a plug connector for receiving similar and/or different modules comprising modules is proposed, namely a method comprising: arranging the modules one beside the other in a longitudinal direction; and joining a first and a second end face of the holding frame form-fittingly such that the modules in the longitudinal direction are arranged one beside the other between the first and the second end face of the holding frame arrangement, and such that at least one transversely extending projection of one of the modules is received in a receptacle in at least one of opposing side surfaces of the holding frame arrangement, which extend between the first and the second end faces. The populating method preferably further comprises, prior to joining the first and second end face, shortening the side surfaces by breaking them at two predetermined breaking points.

In known holding frames, where the distance between the end faces ultimately determines how many modules can be inserted between them, or how many module slots are present in the holding frames, the end faces were fixedly joined to each other, due to their design, via the side walls, edges or flanges of the holding frame, such that there is no flexibility there with regard to the distance between them.

It the context of embodiments of the invention, it was realized that a desired flexibility can be achieved when the combination of a (partial) end face, side surface and (partial) side surface is an integral part, and that the end faces can instead be form-fittingly joined to each other (and ultimately to the side surfaces as well, therefore), the form-fitting connection being provided in different directions between parts of side surfaces that are each embodied in combination with the end faces and/or that can be embodied between at least one end face and the side surfaces.

The form fit is preferably designed in such a way that forces arising when using the plug connector only occur transversely to a direction of movement which releases the form fit, and/or that any releasing of the form fit by forces arising as a result of the installing the holding frame formed from the holding frame arrangement is prevented or at least made more difficult.

Without the holding arrangement itself having to have a locking mechanism, it is possible for a direction in which the form fit does not block movement, i.e., a direction in which the parts of the holding frame arrangement can be brought together and/or separated from each other again, to run parallel in each case to a plug-in direction of the plug connector, in the longitudinal direction of the resultant holding frame (i.e., lengthwise along the side surfaces) and/or in the transversal direction of the resultant holding frame (i.e., lengthwise along the end faces).

In an advantageous embodiment of one aspect of the invention, the holding frame arrangement comprises a first and a second frame portion, wherein the first frame portion includes the first end face and a first and second side surface portion, wherein the second frame portion includes the second end face and a third and fourth side surface portion, wherein the first and second frame portion are mateable with each other in the longitudinal direction of the holding frame arrangement, and wherein the second frame portion has at least one guide means or device for the first and/or second side surface portion.

The two frame portions of the holding frame arrangement can be pushed towards one another along the guide means or device. Preferably before the frame portions are inserted into each other, the desired number of modules can be inserted between the side surface portions of a frame portion, after which the inserted modules can then be fixed between the end faces by inserting or plugging the frame portions into each other.

The desired (maximum) number of modules or module slots provided in the resultant holding frame can be reduced by shortening the side surface portions. In a somewhat more complicated configuration, the number of module slots available can also be (subsequently) increased when the frame portions are modular or extendable in structure.

Known holding frames for plug connectors are typically screwed or similarly fixed at the point of use, and known ways of screwing or otherwise fixing the end faces in place can effectively prevent inadvertent release of the frame portions in this case.

In a particularly advantageous variant of the above embodiment, at least one of the side surface portions has a slot extending in the longitudinal direction, through which the projection of a module can pass, wherein the slot is blocked at least partially by another side surface portion when side surface portions are mated with each other.

Due to a slot being provided in a corresponding side surface portion, the projection from the module can be guided within the slot so that the projection(s) of the module or modules do not, for example, necessitate the side surfaces being spread apart in order to accommodate the projections in the receptacle(s).

The above variant may also be embodied advantageously in such a way that the slot has recesses, each of which forms a receptacle for the projection of a module, together with the other side surface portion, when the side surface portions are mated with each other.

When the respectively provided modules with projections guided by the slot(s) are inserted between two corresponding side surface portions, and the projections are each received in the recesses, the slot can be at least partially closed or covered, by inserting the second frame portion onto or into the first frame portion, in such a way that the modules are fixed in place between the side surface portions by the projections which are then held in the recesses.

In an advantageous embodiment of one aspect of the invention, the first end face can be joined form-fittingly to at least one of the side surfaces of the holding frame arrangement.

In a particularly advantageous variant of the above embodiment, each side surface forms, together with the first end face, a linear guide means or device which allows mating in a direction parallel to the side surface and to the end face, wherein the side surface and the first end face are adapted to form a dovetail joint and/or a mushroom joint with each other.

The guide direction of the linear guide means or device thus runs substantially parallel to a plug-in direction of the resultant plug connector.

There is no necessity here for the linear guide means or device to extend through the entire component. Partial extension, for example by providing the guide means or device only partially in the plug-in direction and/or by blocking the guide means or device at one end, can be advantageously used to make it more difficult for components of the holding frame to inadvertently come apart during installation.

In another particularly advantageous variant of the above embodiment, the form fit is adapted for joining and releasing in the transversal direction, wherein the end face and at least one side surface can each be joined together like pieces of a jigsaw puzzle.

If the connection points have matching projections and recesses in the planes defined by the side surfaces, like pieces of a jigsaw puzzle, the connections can be made in a simple manner by mating them transversely to that plane.

In another advantageous embodiment of one aspect of the invention, the side surfaces and the side surface portions each have predetermined breaking points for shortening them by integer multiples of a module width.

At a predetermined breaking point where the material is thinner, for example, it is possible to shorten a side surface or side surface portion by breaking off a piece in an appropriate manner. The module width is defined by the offset between two adjacent recesses for receiving the projections from the modules.

In a particularly advantageous variant of the embodiment of one aspect of the invention, in which each at least one side surface forms, together with the first end face, a linear guide means or device which allows mating in a direction parallel to the side surface and to the end face, wherein the side surface and the first end face are adapted to form a dovetail joint and/or a mushroom joint with each other and the side surfaces each have predetermined breaking points for shortening them by integer multiples of a module width, the at least one side surface has a guide element matching the first end face, adjacent to each predetermined breaking point in the longitudinal direction.

The linear guide means or device requires an edge that is substantially planar (without projections, at least) in the respective direction, and such an edge may correlate in a simple manner with a predetermined breaking point which then runs likewise in a straight line.

Features of advantageous embodiments of the invention are defined in the claims, and a person skilled in the art can also find other advantageous features, embodiments and variants of the invention in the above description and the discussion below.

BRIEF DESCRIPTION OF THE SEVERAL VIEWS OF THE DRAWINGS

In the following, the present invention shall be illustrated and described with reference to the embodiments shown in the Figures.

In the enclosed drawings and in the associated descriptions of said drawings, corresponding or related elements are given corresponding or similar reference signs, where expedient, even when they are to be found in different embodiments.

DETAILED DESCRIPTION

Figure 1:
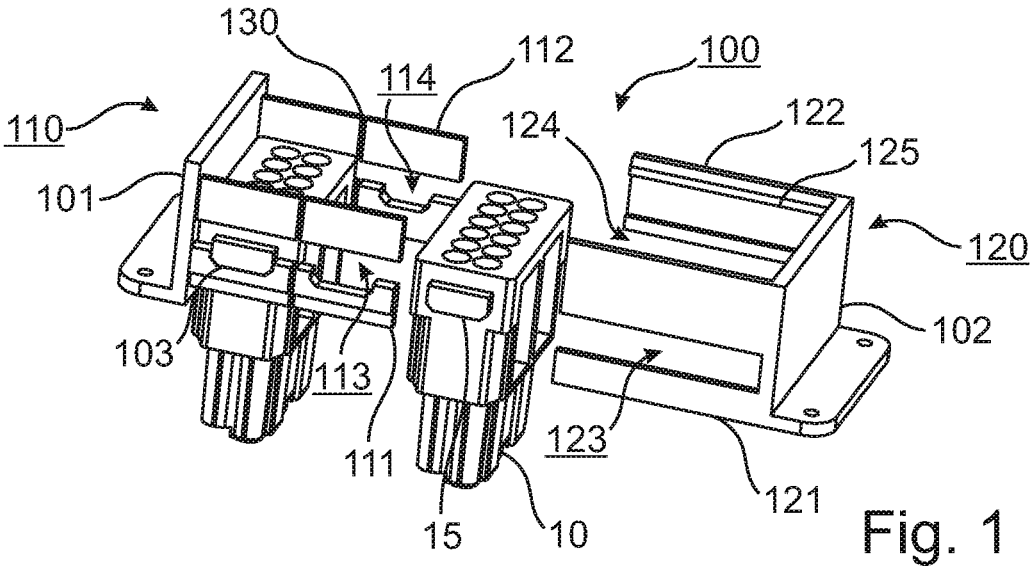
FIG. 1 shows a schematic view illustrating a first embodiment of a holding frame arrangement according to the invention, comprising modules for a plug connector.

FIG. 1 shows a schematic view illustrating a first embodiment of a holding frame arrangement 100 according to the invention, comprising modules 10 for a plug connector.

Holding frame arrangement 100 comprises a first frame portion 110 and a second frame portion 120.

The first frame portion 110 comprises a first end face 101 and a first and a second side surface portion 111, 112, each extending transversely to end face 101 from the ends of end face 101. Side surface portions 111, 112 each have a slot 113, 114 extending in their longitudinal direction (i.e., likewise transversely to end face 101).

Slots 113, 114 run parallel to each other and are each designed to be so wide that a projection 15 from a module 10 for the plug connector can be guided through a respective slot.

Slots 113, 114 also have recesses 103 offset from each other by the width of a (single) module and which are designed to match the width of the projections 15 from the modules 10.

In the view shown in FIG. 1, a module 10 is already inserted into slots 113, 114 and thus between side surface portions 111, 112, and into frame portion 110, and rests in the first (left-hand) recess 103 directly adjacent to end face 101. Another module 10 is shown beside frame portion 110.

Side surface portions 111, 112 also have predetermined breaking points 130 extending in the mating direction of the plug connector. The holding frame arrangement 100 illustrated in FIG. 1 is configured to receive two modules 10, and the frame portion can be shortened to receive only one module 10 by using predetermined breaking points 130. In a typical implementation, holding frame arrangement 100 could be configured to receive six single modules 10, in which case FIG. 1 illustrates a version which has already been shortened by four module widths.

The second frame portion 120 comprises a second end face 102 and a third and fourth side surface portion 121, 122 each extending transversely to end face 102 from the ends of end face 102. Side surface portions 121, 122 each have a slot 123, 124 extending in their longitudinal direction (i.e., likewise transversely to end face 102).

Slots 123, 124 are arranged to match slots 113, 114 and are dimensioned such that, when frame portions 110, 120 are plugged together, part of slots 113, 114 is blocked in such a way that the projections 15 from inserted modules 10 are fixed in place in recesses 103.

When frame portions 110, 120 are plugged together, a guide means or device 125 provided on the inner side of side surface portions 121, 122 clasps a part of side surface portions 111, 112 that is above slots 113, 114, such that frame portions 110, 120 are brought together in a predetermined manner.

No separate predetermined breaking points are shown for the second frame portion 120, although such predetermined breaking points corresponding to predetermined breaking points 130 of the first frame portion 110 may be provided. Then again, predetermined breaking points could also be dispensed with in the case of the first frame portion 110, with appropriate shortening being left to the user.

Adjoining each end face 101, 102, there is a mounting shoulder or flange with which the holding frame (i.e., the assembled holding frame arrangement 100) can be mounted in a known manner during installation. This mounting prevents frame portions 110, 120 from detaching inadvertently from each other.

Figure 2:
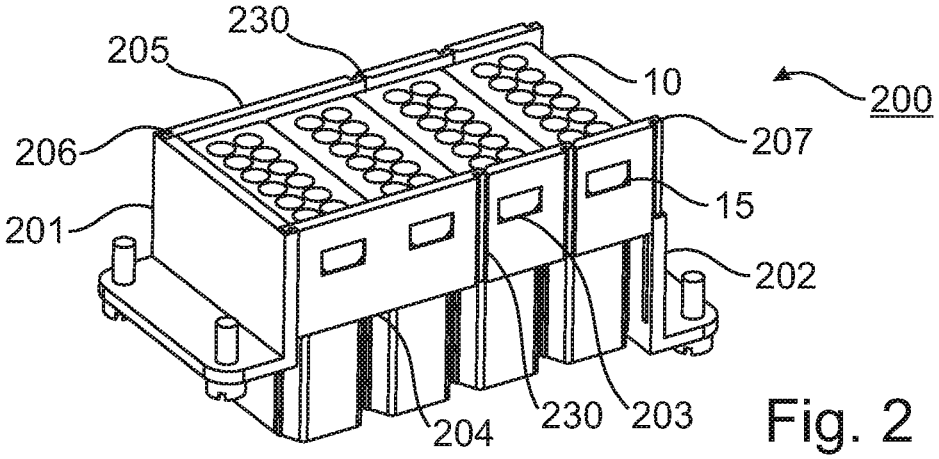
FIG. 2 shows a schematic view illustrating a second embodiment of a holding frame arrangement according to the invention, comprising modules for a plug connector.

FIG. 2 shows a schematic view illustrating a second embodiment of a holding frame arrangement 200 according to the invention, comprising modules 10 for a plug connector.

Holding frame arrangement 200 comprises a first and a second end face 201, 202, which are connected form-fittingly to each other in the assembled state (only hinted at in FIG. 2) by two side surfaces 204, 205.

Side surfaces 204, 205 each have receptacles 203 for projections 15 from modules 10, offset from each other by the width of a single module, such that modules 10 are fixed in place in the holding frames thus produced.

Side surfaces 204, 205 shown in FIG. 2 have a length corresponding to four modules 10, with side surfaces 204, 205 each having two predetermined breaking points 230 for shortening that length to three or two modules 10.

At their ends in the longitudinal direction, side surfaces 204, 205 each have a dovetail 207 for insertion into a linear guide 206 in end faces 201, 202 (see, in particular, the right-hand side of the view shown in FIG. 2).

In the embodiment shown in FIG. 2, a section extending from one end of side surfaces 204, 205 to a first predetermined breaking point 230 is provided with dovetails on both sides, whereas the other sections likewise have a dovetail between predetermined breaking points 230 only on the side away from the first section. After breaking off at the predetermined breaking point, such a section can no longer be used, therefore, to connect the two end faces 201, 202, due to the absence of the second dovetail. The embodiment shown in FIG. 2 can therefore be shortened to two module slots.

In other variants (not shown), the ends of the side surfaces 204, 205 may also be symmetrical, for example with a dovetail or mushroom cross-section.

The cross-section of the side surfaces 204, 205 may also be shaped accordingly on either side of a predetermined breaking point such that practically any subdivisions of a prefabricated side surface can be used to connect the end faces 201, 202.

The side surfaces 204, 205 may be designed to be mirror or axially symmetrical with each other. If, however, by providing differently designed receptacles 203 (e.g., with different sizes), the aim is to ensure that the modules 10 can only be arranged in a clearly defined manner with respect to each other when mounted, then the side surfaces 204, 205 will differ by those receptacles 203.

It is possible to produce the side surfaces 204, 205 by extrusion or extrusion pressing with a desired cross-section in which the guide members, engaging parts and the predetermined breaking points are already preformed. The side surfaces 204, 205 can be prepared by cutting the respective strands to the height of the side surfaces 204, 205 and by punching out the receptacles 203, for example. The opposite side surfaces 204, 205 with different receptacles 203 can be produced in a common process, with the only difference being the specific way that the receptacles 203 are punched out or otherwise produced.

In the embodiment shown in FIG. 2, the modules 10 provided for the plug connector can be firstly arranged one beside the other, for example, after which side surfaces 204, 205 are attached in such a way that receptacles 203 receive projections 15 on the modules 10. End faces 201, 202 can then be pushed successively or simultaneously onto the dovetails 207 of the side surfaces using linear guide 206.

Similar to the embodiment illustrated in FIG. 1, end faces 201, 202 are provided with mounting shoulders or flanges which allow the resultant holding frame to be mounted in a known manner when assembled.

Figure 3:
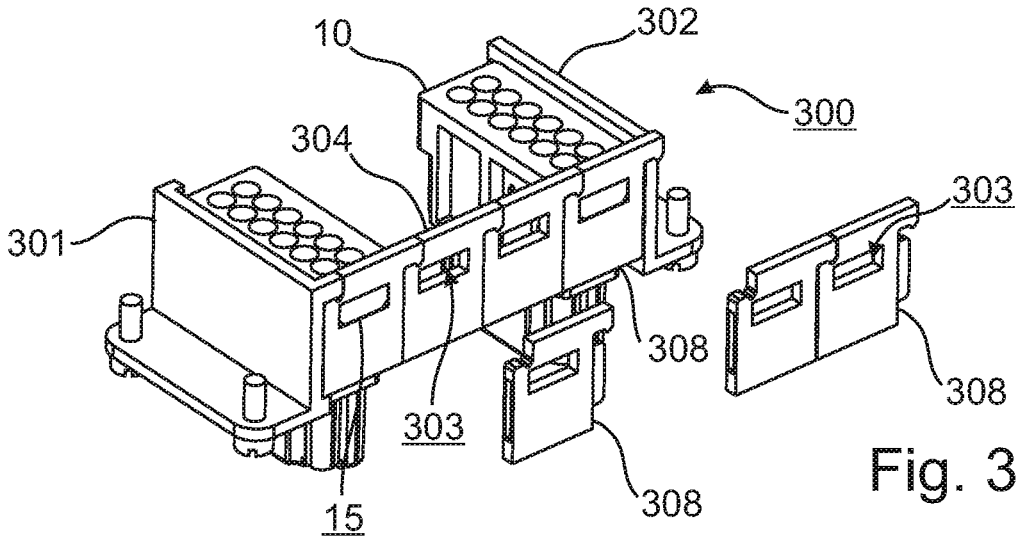
FIG. 3 shows a schematic view illustrating a third embodiment of a holding frame arrangement according to the invention, comprising modules for a plug connector.

FIG. 3 shows a schematic view illustrating a third embodiment of a holding frame arrangement 300 according to the invention, comprising modules 10 for a plug connector.

Holding frame arrangement 300 comprises a first and a second end face 301, 302, which are connected form-fittingly to each other in the assembled state (only hinted at in FIG. 3) by two side surfaces 304.

The side surfaces 304, only one of which is shown in FIG. 3, are composed of side surface portions 308 which are each provided, like pieces of a jigsaw puzzle, with suitable contours when viewed from the side, which allow side surface portions 308 to engage in each other in the longitudinal direction of the resultant holding frame, end faces 301, 302 being provided with matching projections and/or recesses such that a desired number of side surface portions 308 can be assembled, in order to form a holding frame with the proper length, i.e., for the desired number of modules, starting at the first end face 301 in each case and finishing with the second end face 302.

As already discussed in connection with the embodiment illustrated in FIG. 2, side surfaces 304 may be symmetrical with or different from each other in this case also. As shown in FIG. 3, it is possible to provide different shapes for the first and the second end face 301, 302, and a variant in which both end faces 201, 202 are identical when rotated about the vertical axis is also possible.

Like the embodiment in FIG. 2, the embodiment in FIG. 3 is not limited to side surface portions 308 only having a length equal to a single module 10. Side surface portions 308 may also be produced in a joined manner (with predetermined breaking points being provided), in order to be separated from each other or joined together again as required.

In the embodiment illustrated, however, side surface portions 308 (and accordingly end faces 301, 302 as well, which are not shown here, however) have elements similar to grooves and tongues, such that, given some flexibility on the part of the projections, side surface portions 308 can be brought together in the longitudinal direction by joining the grooves and tongues, such that any transverse displacement is precluded.

As already noted with reference to FIG. 1 and FIG. 2, when describing the embodiments therein, end faces 301, 302 also have attachment means (e.g., mounting shoulders or flanges) for mounting the holding frame arrangement 300.

Figure 4:
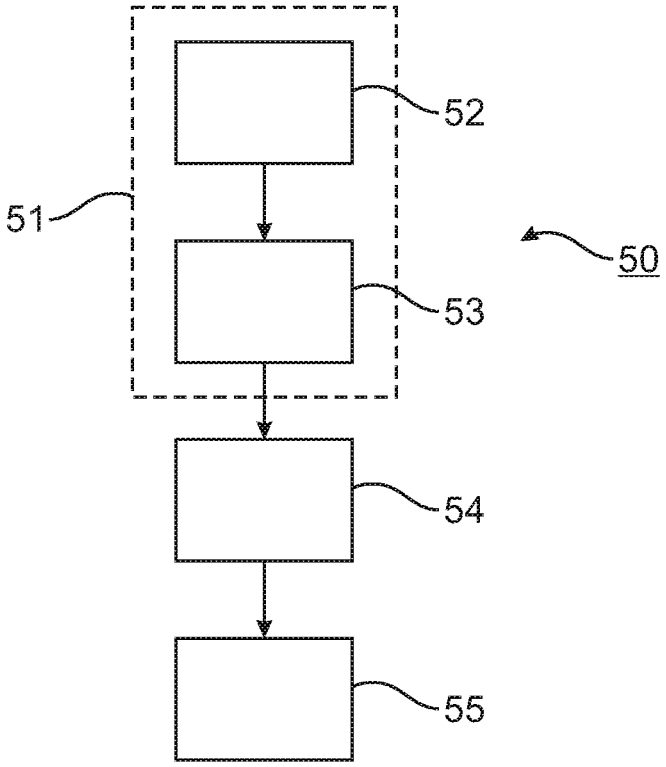
FIG. 4 a schematic flow diagram of an embodiment of a populating method according to the invention for a holding frame arrangement for a plug connector, including a corresponding assembly method.

FIG. 4 shows a schematic flow diagram of an embodiment of a populating method 50 according to the invention for a holding frame arrangement for a plug connector, including a corresponding assembly method 51.

In the embodiment illustrated, assembly method 51 comprises providing 52 a holding frame arrangement according to an embodiment of the invention for a plug connector for receiving similar and/or different modules, namely a holding frame arrangement with two end faces which can be joined to each other form-fittingly.

In at least one of the side surfaces of the holding frame arrangement, which extend between the end faces in the assembled state, a respective receptacle is provided for projections from modules for the plug connector.

The side surfaces each have predetermined breaking points for shortening them by integer multiples of a module width.

The assembly method further comprises shortening 53 the side surfaces by breaking them at two predetermined breaking points.

Assembly method 51 is followed by arranging 54 the modules for the plug connector one beside the other in a longitudinal direction.

Then at 55, the end faces of the holding frame arrangement are joined form-fittingly such that the modules in the longitudinal direction are arranged one beside the other between the first and the second end face of the holding frame arrangement, and such that at least one transversely extending projection of a module is received in a receptacle in at least one of the side surfaces of the holding frame arrangement, which extend between the first and the second end faces.

Even if different aspects or features of the invention are shown in combination in the Figures, it is clear to a person skilled in the art, unless otherwise specified, that the combinations shown and discussed are not the only ones possible. More particularly, it is possible to swap corresponding units or groups of features from different embodiments.

For example, it is possible that the lugs for joining the side surfaces to the end faces are also implemented in connection with the embodiment in which the holding frame arrangement has two frame portions which are mateable with each other in the longitudinal direction of the holding frame arrangement, the second frame portion having at least one guide means or device for the first and/or the second side surface portion. In this regard, more particularly, the side surface portions may be form-fittingly connected or connectable to each other and/or to the respective end faces, so this embodiment, too, is not limited to integral frame portions.

It is also possible to combine or deploy embodiments of the present invention with the teaching of, for example, EP 0 860 906 B1 (with a hinged connection within the end faces that allows the holding frame to be spread apart), EP 2 581 991 A1 (allowing linear displacement in the end faces), EP 1 801 927 B1 (embodiment as injection-molded plastic parts having elastic properties) and/or DE 10 2013 113 976 A1 (using different materials, combining stiffness of the holding frame as a whole with preferably elastic flexibility at desired points).

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame arrangement for a plug connector for receiving modules, wherein:

the holding frame arrangement is configured to be populated with modules arranged one beside the other in a longitudinal direction of the holding frame arrangement between a first and a second end face of the holding frame arrangement;

the first and the second end faces are configured to be joined to each other form-fittingly such that, in a populating state, at least one transversely extending projection of one of the modules is received in a receptacle in at least one of opposing side surfaces of the holding frame arrangement, which extend between the first and the second end faces;

the holding frame arrangement comprises a first frame portion and a second frame portion, the first frame portion including the first end face and a first and a second side surface portion, the second frame portion including the second end face and a third and a fourth side surface portion, wherein the first and second frame portions are mateable with each other in the longitudinal direction of the holding frame arrangement, and wherein the second frame portion has at least one guide device for the first and/or second side surface portion of the first frame portion; and at least one of the side surface portions has a slot extending in the longitudinal direction, through which the projection of the module can pass, wherein the slot is blocked at least partially by another one of the side surface portions when the side surface portions are mated with each other.

2. The holding frame arrangement according to claim 1, wherein the slot has recesses, each of which forms a respective receptacle for a respective projection of the modules, together with the other one of the side surface portions, when the side surface portions are mated with each other.

3. The holding frame arrangement according to claim 1, wherein the first end face can be joined form-fittingly to at least one of the side surfaces of the holding frame arrangement.

4. A holding frame arrangement for a plug connector for receiving modules, wherein the holding frame arrangement is configured to be populated with modules arranged one beside the other in a longitudinal direction of the holding frame arrangement between a first and a second end face of the holding frame arrangement, wherein the first and the second end faces are configured to be joined to each other form-fittingly such that, in a populating state, at least one transversely extending projection of one of the modules is received in a receptacle in at least one of opposing side surfaces of the holding frame arrangement, which extend between the first and the second end faces, and wherein the side surfaces each have predetermined breaking points for shortening the side surfaces by integer multiples of a module width.

5. The holding frame arrangement according to claim 4, wherein each side surface has a respective guide element matching the first end face, adjacent to each predetermined breaking point in the longitudinal direction.

6. An assembly method comprising:

providing a holding frame arrangement for a plug connector for receiving modules, wherein the holding frame arrangement is configured to be populated with modules arranged one beside the other in a longitudinal direction of the holding frame arrangement between a first and a second end face of the holding frame arrangement, wherein the first and the second end faces are configured to be joined to each other form-fittingly such that, in a populating state, at least one transversely extending projection of one of the modules is received in a receptacle in at least one of opposing side surfaces of the holding frame arrangement, which extend between the first and the second end faces, and wherein the side surfaces each have predetermined breaking points for shortening the side surfaces by integer multiples of a module width; and shortening the side surfaces of the holding frame arrangement by breaking the side surfaces at two predetermined breaking points.

7. A populating method for a holding frame arrangement for a plug connector for receiving similar or different modules, said method comprising:

arranging the modules one beside the other in a longitudinal direction;

joining a first and a second end face of the holding frame arrangement form-fittingly such that the modules in the longitudinal direction are arranged one beside the other between the first and the second end face of the holding frame arrangement, and such that at least one transversely extending projection of one of the modules is received in a receptacle in at least one of opposing side surfaces of the holding frame arrangement, which extend between the first and the second end faces; and prior to joining the first and second end face, shortening the side surfaces of the holding frame arrangement by breaking the side surfaces at two predetermined breaking points.

* * * * *